US011519396B2

(12) United States Patent
Kumar et al.

(10) Patent No.: US 11,519,396 B2
(45) **Date of Patent: *Dec. 6, 2022**

(54) RECIPROCATING PUMP

(71) Applicant: SPM Oil & Gas Inc., Fort Worth, TX (US)

(72) Inventors: Chandu Kumar, Fort Worth, TX (US); John S. Marquez, Fort Worth, TX (US); Bryan Wagner, Fort Worth, TX (US); Kourosh Momenkhani, Dallas, TX (US); Justin Rand Cummings, Fort Worth, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 163 days.

This patent is subject to a terminal disclaimer.

(21) Appl. No.: 17/008,645

(22) Filed: Sep. 1, 2020

(65) Prior Publication Data

US 2020/0400132 A1 Dec. 24, 2020

Related U.S. Application Data

(63) Continuation of application No. 16/182,581, filed on Nov. 6, 2018, now Pat. No. 10,781,803.

(Continued)

(51) Int. Cl.

| | |
|---|---|
| ***F04B 19/22*** | (2006.01) |
| ***F04B 39/12*** | (2006.01) |
| ***F04B 53/16*** | (2006.01) |
| ***F04B 1/0421*** | (2020.01) |
| ***F04B 1/0538*** | (2020.01) |

(Continued)

(52) U.S. Cl.

CPC ..... *F04B 19/22* (2013.01); *F04B 1/0404* (2013.01); *F04B 1/0421* (2013.01); *F04B 1/053* (2013.01); *F04B 1/0538* (2013.01); *F04B 39/121* (2013.01); *F04B 39/122* (2013.01); *F04B 39/126* (2013.01); *F04B 53/162* (2013.01); *E21B 33/068* (2013.01); *E21B 43/26* (2013.01); *E21B 43/2607* (2020.05); *F04B 9/045* (2013.01); *F04B 17/05* (2013.01); *F05B 2230/90* (2013.01); *F05B 2280/10721* (2013.01); *F05B 2280/6011* (2013.01)

(58) Field of Classification Search

CPC ..... F04B 19/22; F04B 23/06; F04B 35/01; F04B 39/12; F04B 39/121; F04B 39/14; F04B 47/02; F04B 53/16; F04B 53/22

See application file for complete search history.

(56) References Cited

U.S. PATENT DOCUMENTS

| | | | | |
|---|---|---|---|---|
| 2,331,513 A | | 10/1943 | Stahl et al. | |
| 2,561,227 A | * | 7/1951 | Reed | F04B 5/00 92/6 R |
| 2,727,469 A | * | 12/1955 | Pinkerton | F04B 7/04 403/243 |
| 4,477,237 A | * | 10/1984 | Grable | F04B 53/00 417/454 |

(Continued)

OTHER PUBLICATIONS

International Search Report and Written Opinion received in Patent Cooperation Treaty Application No. PCT/US2018/059705, dated Jan. 18, 2019, 9 pages.

*Primary Examiner* — Thomas E Lazo

(74) *Attorney, Agent, or Firm* — Baker Botts, L.L.P.

(57) ABSTRACT

A reciprocating pump includes a frame for a power end, a skid support structure integrally formed at a base of the power end frame to provide proper support and rigidity for the pump power end, where the integral skid support structure has a plurality of struts forming a series of chambers.

17 Claims, 11 Drawing Sheets

Related U.S. Application Data

(60) Provisional application No. 62/582,933, filed on Nov. 7, 2017, provisional application No. 62/582,931, filed on Nov. 7, 2017, provisional application No. 62/582,927, filed on Nov. 7, 2017.

(51) Int. Cl.

| | |
|---|---|
| ***F04B 1/0404*** | (2020.01) |
| ***F04B 1/053*** | (2020.01) |
| *E21B 33/068* | (2006.01) |
| *E21B 43/26* | (2006.01) |
| *F04B 17/05* | (2006.01) |
| *F04B 9/04* | (2006.01) |

(56) References Cited

U.S. PATENT DOCUMENTS

| | | | | |
|---|---|---|---|---|
| 4,566,370 | A * | 1/1986 | Hanafi | F04B 53/00 74/44 |
| 4,638,971 | A * | 1/1987 | Basinsky | F16M 5/00 248/676 |
| 9,879,659 | B2 | 1/2018 | Kumar et al. | |
| 10,781,803 | B2 * | 9/2020 | Kumar | F04B 1/0538 |
| 2012/0279721 | A1 | 11/2012 | Surjaatmadja et al. | |
| 2016/0025082 | A1 * | 1/2016 | Byrne | B21K 23/00 29/888.03 |
| 2016/0090980 | A1 * | 3/2016 | Howard | F04B 51/00 417/63 |
| 2016/0177945 | A1 | 6/2016 | Byrne et al. | |
| 2017/0211565 | A1 | 7/2017 | Morreale | |
| 2017/0292515 | A1 | 10/2017 | Underys et al. | |

* cited by examiner

RECIPROCATING PUMP

RELATED APPLICATIONS

This application is a continuation of U.S. application Ser. No. 16/182,581 filed Nov. 6, 2018, which claims the benefit of U.S. Provisional Application No. 62/582,927 filed Nov. 7, 2017, U.S. Provisional Application No. 62/582,931 filed Nov. 7, 2017 and U.S. Provisional Application No. 62/582,933 filed Nov. 7, 2017, all of which are incorporated herein in their entirety.

FIELD

The present disclosure relates to high pressure pumps, and in particular, to a novel reciprocating pump with an integrated skid support structure, integral crosshead and noseplate structure, stay rod tube assembly, and crosshead with integrated wear coating.

BACKGROUND

High-pressure pumps are used in a variety of industrial settings. One use for such pumps is in the oil and gas industry and, specifically to pumps used in completion and stimulation operations including fracturing, cementing, acidizing, gravel packing, snubbing, and similar operations. For example, hydraulic well fracturing treatments are well known and have been widely described in the technical literature dealing with the present state of the art in well drilling, completion, and stimulation operations. Hydraulic fracturing is a process to obtain hydrocarbons such as natural gas and petroleum by injecting a fracking fluid or slurry at high pressure into a wellbore to create cracks in deep rock formations. In a typical hydraulic fracturing operation, the subterranean well strata are subjected to tremendous pressures in order to create fluid pathways to enable an increased flow of oil or gas reserves that may then be brought up to the surface. The fracking fluids are pumped down the wellhead by high-pressure pumps located at the well surface. An example of such a pump is the SPM QWS 2500 XL Frac Pump manufactured and sold by The Weir Group.

Also referred to as a positive displacement pump, these high-pressure pumps may include one or more plungers driven by a crankshaft to create alternately high and low pressures in a fluid chamber. A positive displacement pump typically has two sections, a power end and a fluid end connected by a plurality of stay rods and tubes. The power end includes a crankshaft powered by an engine that drives the plungers. The fluid end of the pump includes cylinders into which the plungers operate to draw fluid into the fluid chamber and then forcibly push out at high pressure to a discharge manifold, which is in fluid communication with a well head.

DETAILED DESCRIPTION

Figure 1:
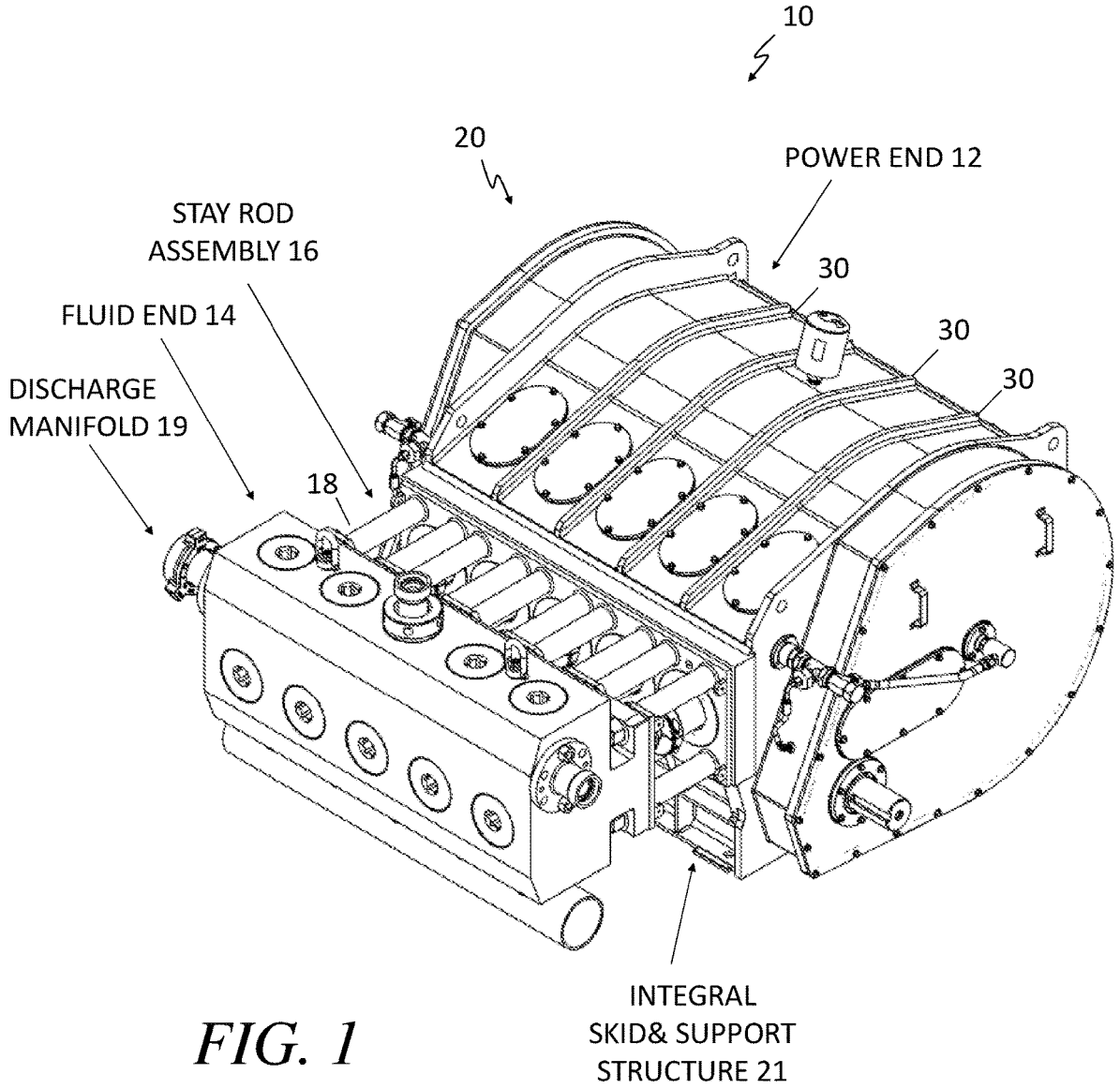
FIG. 1 is a perspective view of an exemplary positive displacement pump according to the teachings of the present disclosure.
Figure 2:
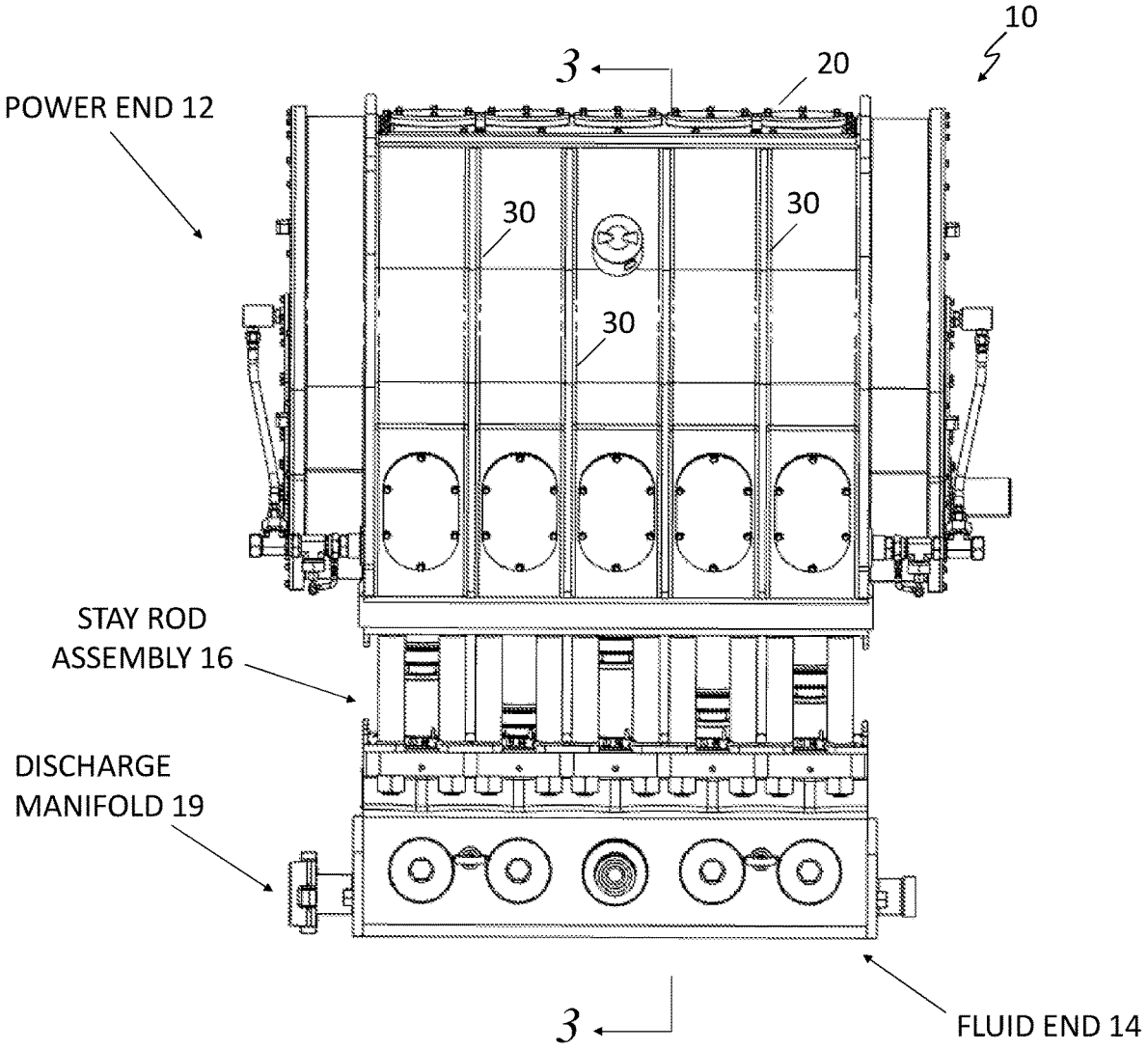
FIG. 2 is a top view of an exemplary positive displacement pump according to the teachings of the present disclosure.
Figure 3:
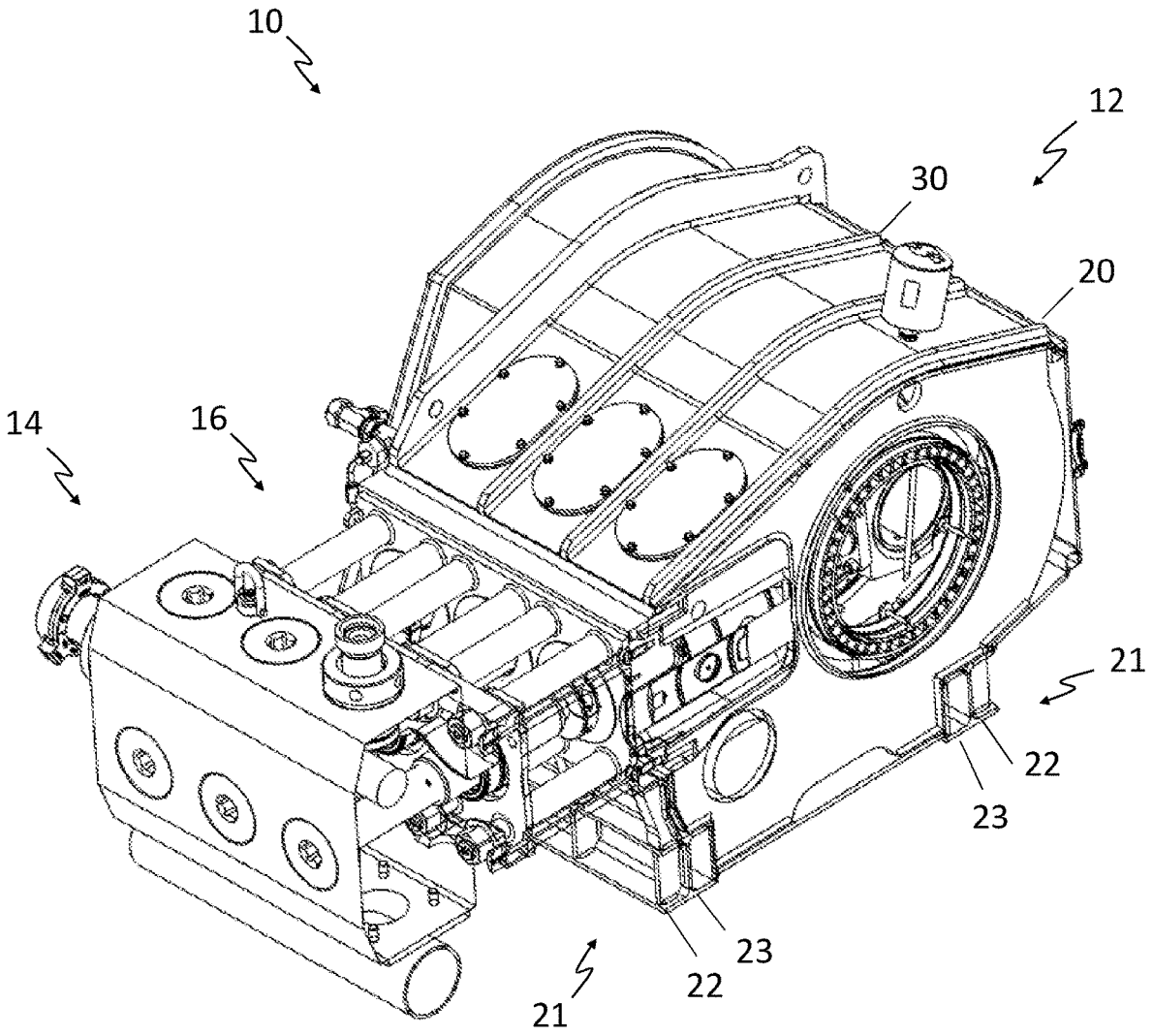
FIG. 3 is a cross-sectional perspective view of an exemplary positive displacement pump taken along line 3-3 in FIG. 2 according to the teachings of the present disclosure.

FIGS. 1-3 present various views of an exemplary positive displacement or frac pump 10 according to the teachings of the present disclosure. The frac pump 10, also called a reciprocating pump, is typically driven by high horsepower diesel or turbine engines (not shown). The engine's revolutions-per-minute (RPM) is usually reduced through the use of a transmission. The transmission is usually multi-geared such that higher pump loads use lower gearing and lighter loads use higher gearing. The frac pump 10 comprises two major components: a power end 12 and a fluid end 14 held together by a stay rod assembly 16 that includes a plurality of stay rods 18 and tubes. The power end 12 includes a crankshaft (not explicitly shown) powered by the engine (not explicitly shown) that drives a plurality of plungers (not explicitly shown). The fluid end 14 of the pump 10 includes cylinders (not explicitly shown) into which the plungers operate to draw fluid into the fluid chamber and then forcibly push out at a high pressure to a discharge manifold 19, which is in fluid communication with a well head (not shown). The frac pump 10 increases pressure within the fluid cylinder by reciprocating the plunger longitudinally within the fluid head cylinder. The power end 12 further includes a pinion gear, bull gears, rod caps, bearing housing, connecting rods, crossheads, and pony rods that work together to reciprocate the plunger. In a conventional pump, each crosshead and pony rod combination is maintained in proper position by a respective large brass cylinder pressed into an individual steel support sleeve welded into the power frame. The connecting rod is connected to the crosshead by a wrist pin inserted through a wrist pin hole positioned in both the connecting rod and the crosshead. Each connecting rod is bolted to individual rod caps that are connected to the crankshaft. The crankshaft is connected to either one or two bull gears that are driven in circular motion by a pinion gear. The crosshead, in turn, is coupled to the pony rod which is connected to a plunger. Thus, the crankshaft's rotational movement is transferred through the connecting rod into linear movement by virtue of the sliding arrangement of the crosshead within the brass sleeve. This linear movement, in turn, moves the crosshead and pony rod, which in turn moves the plunger in, on pressure stroke and out on suction stroke, in a linear fashion. Because of the extreme conditions under which a frac pump operates, some of which are discussed above, there is considerable wear and tear on the various component parts. Such wear and tear require constant maintenance, and ultimately, replacement of worn parts. Maintenance and repair result in machine downtime and increase the overall cost of oil and gas production.

Figure 4:
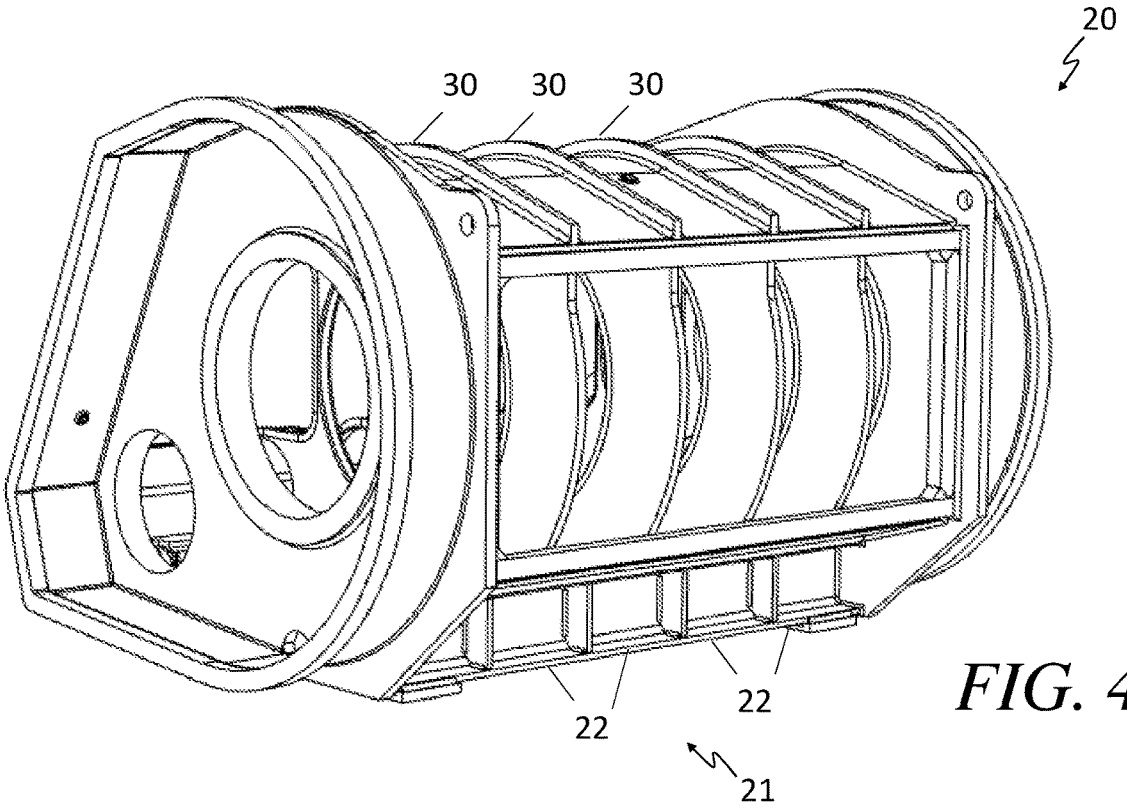
FIGS. 4 and 5 are two perspective views of an exemplary embodiment of a power end frame of the exemplary positive displacement pump according to the teachings of the present disclosure.
Figure 5:
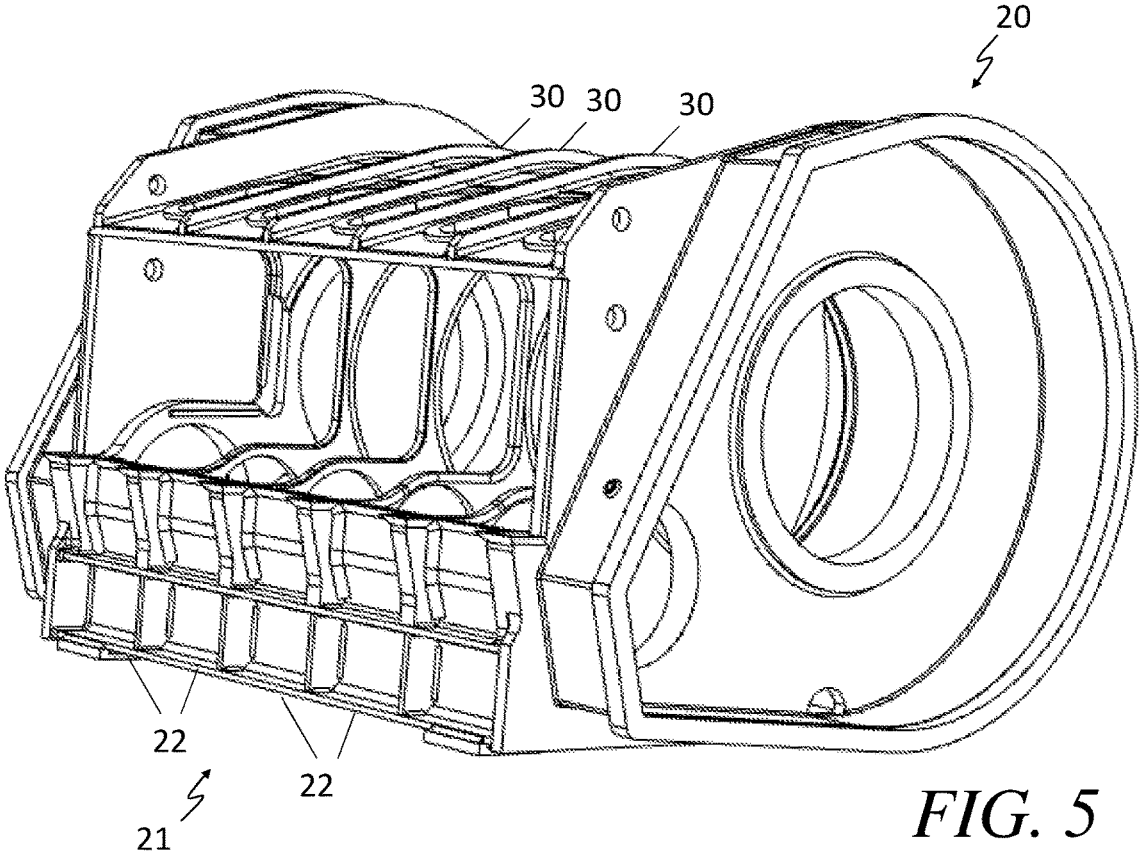
Figure 6:
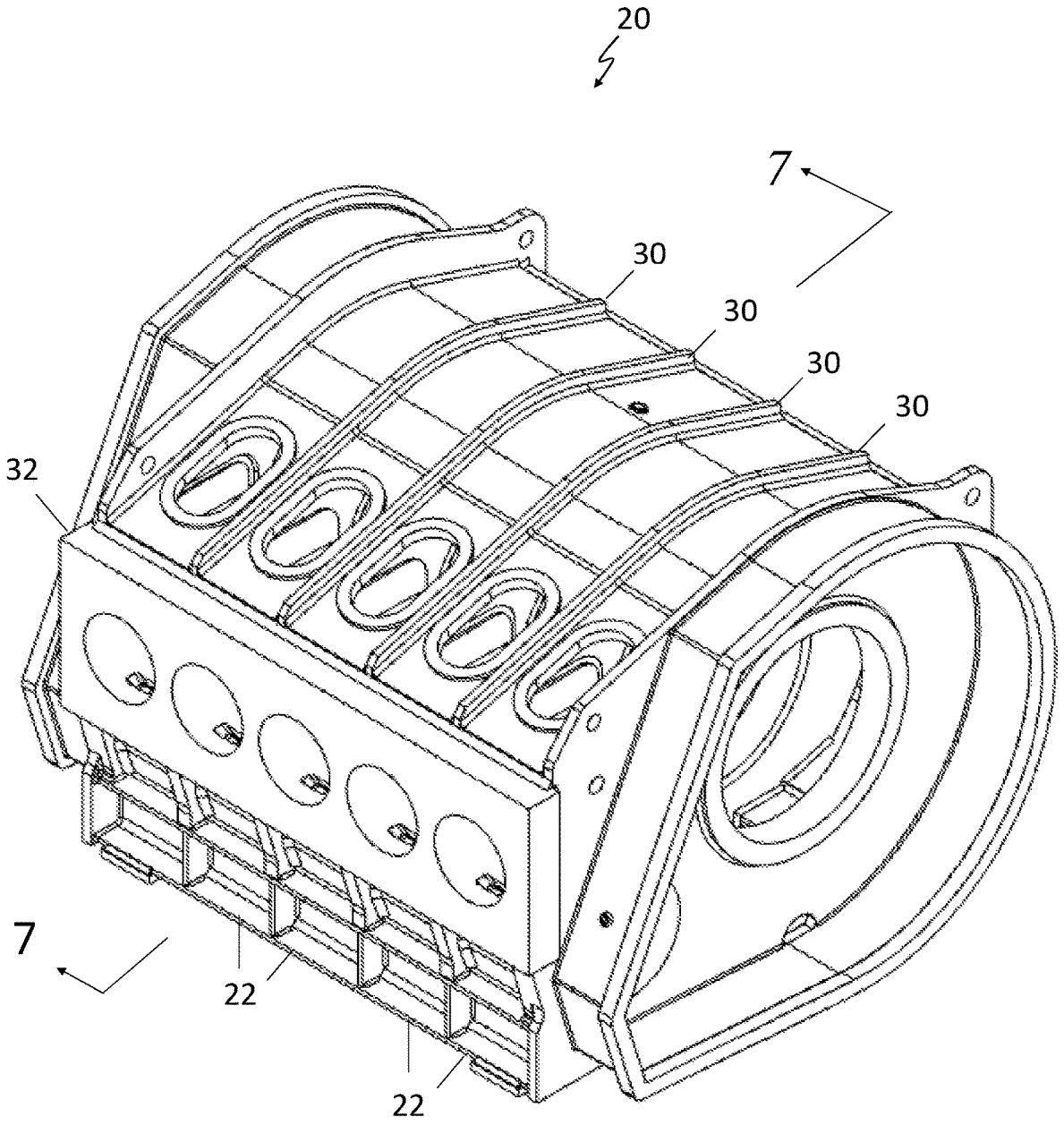
FIG. 6 is a perspective view of an exemplary embodiment of a power end frame of an exemplary positive displacement pump with an integral crosshead guide tubes and noseplate structure according to the teachings of the present disclosure.
Figure 7:
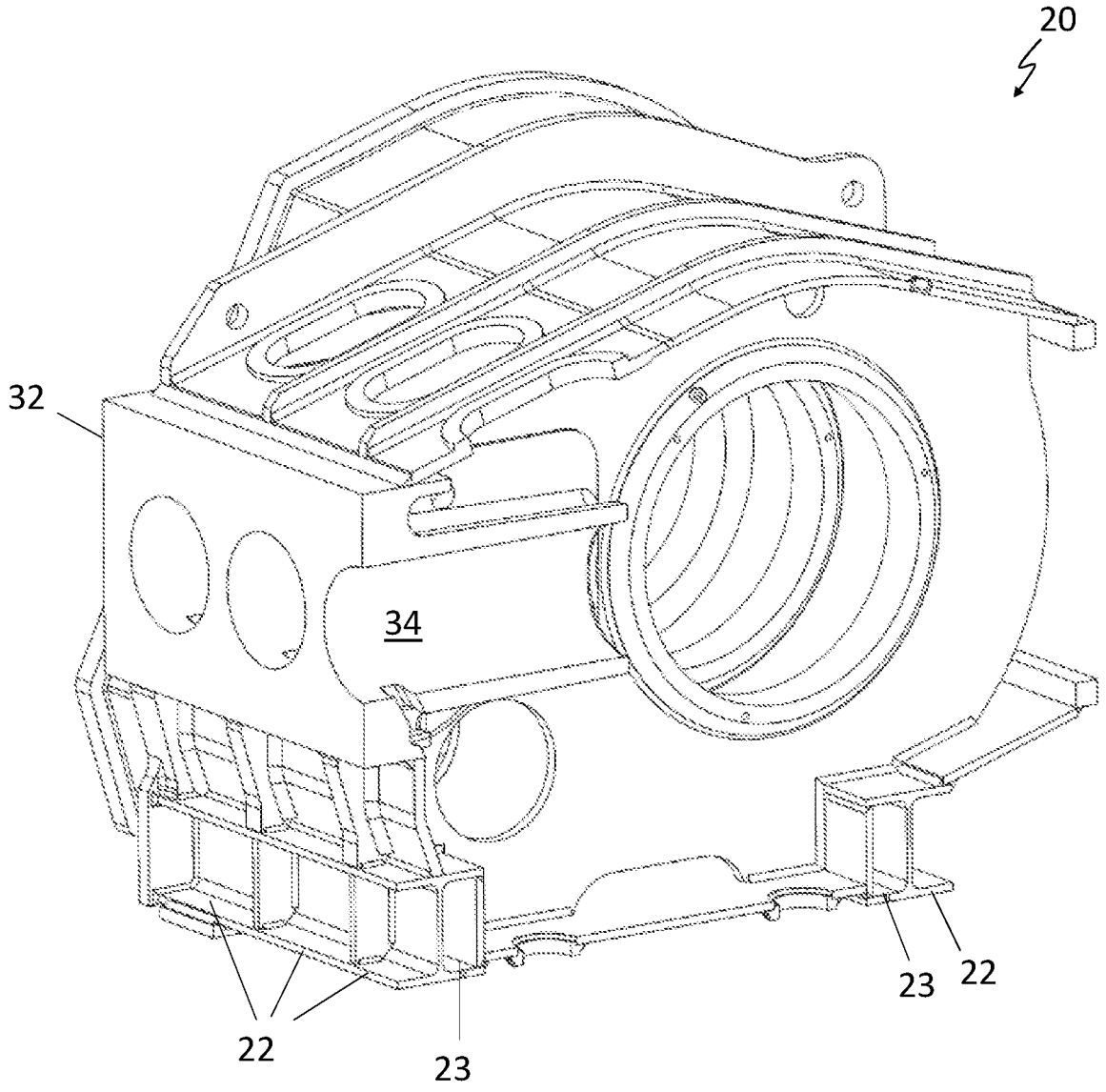
FIG. 7 is a cross-sectional perspective view of an exemplary embodiment of a power end frame of an exemplary positive displacement pump with an integral crosshead guide tubes and noseplate structure taken along line 7-7 in FIG. 6 according to the teachings of the present disclosure.
Figure 8:
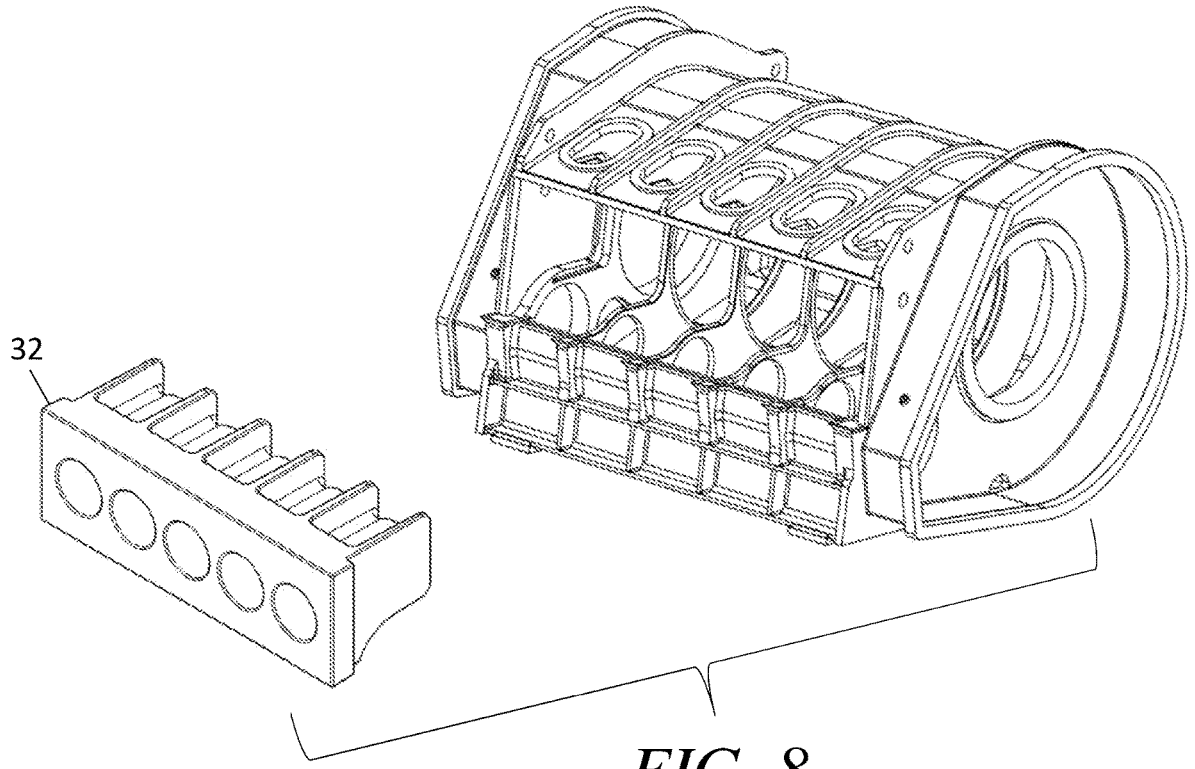
FIGS. 8 and 9 are perspective and side exploded views of an exemplary embodiment of a power end frame of an exemplary positive displacement pump with an integral crosshead guide tubes and noseplate structure according to the teachings of the present disclosure.
Figure 9:
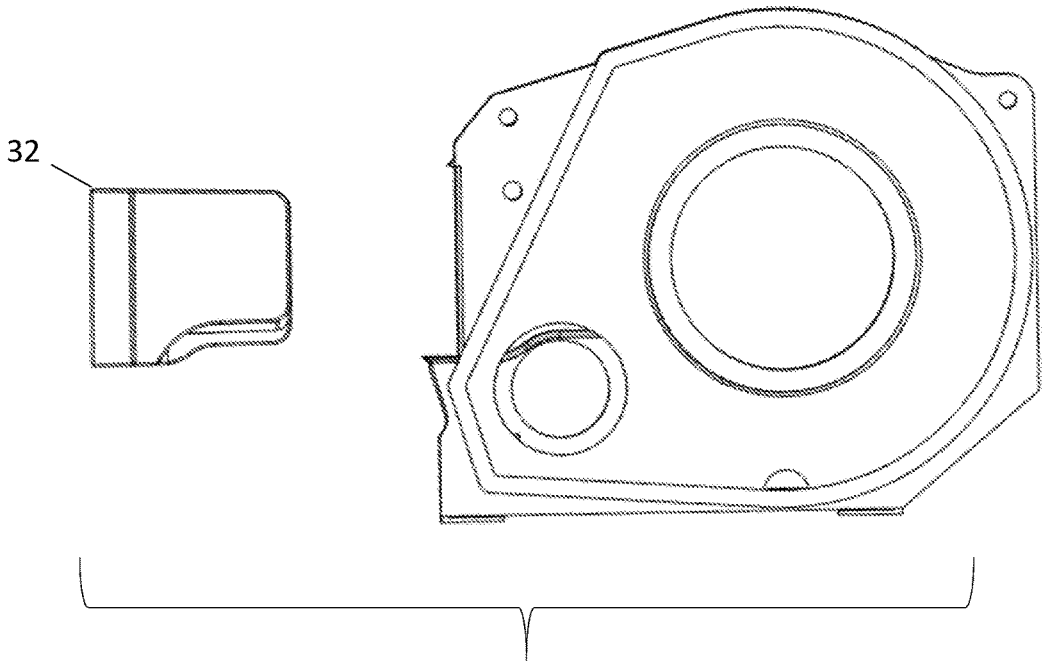
Figure 10:
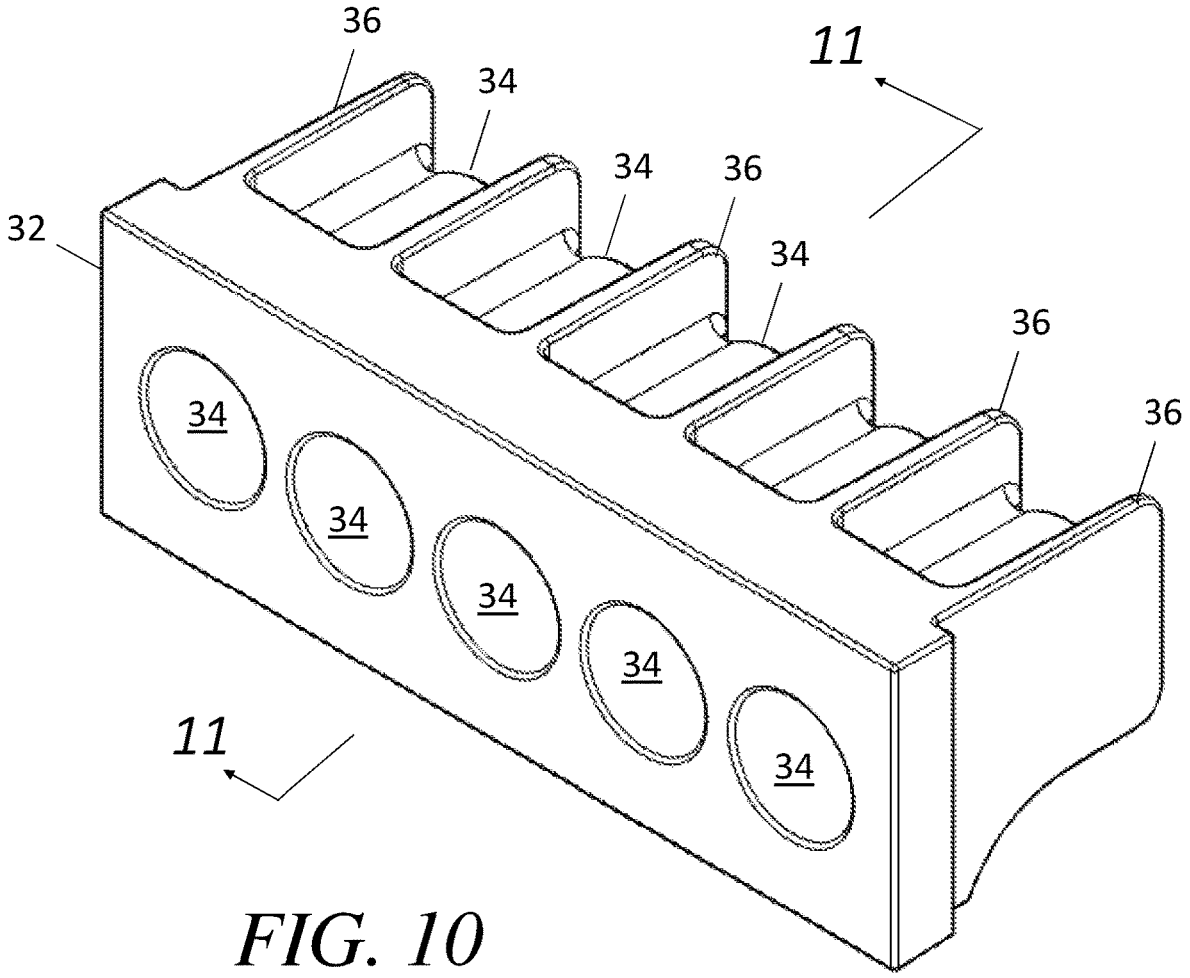
FIG. 10 is a perspective view of an exemplary embodiment of an integral crosshead guide tubes and noseplate structure according to the teachings of the present disclosure.
Figure 11:
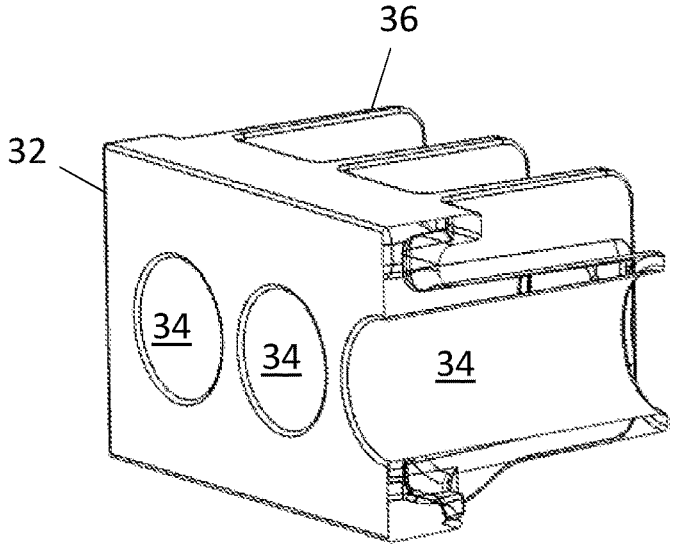
FIG. 11 is a perspective cross-sectional view of an exemplary embodiment of an integral crosshead guide tubes and noseplate structure taken along line 11-11 in FIG. 10 according to the teachings of the present disclosure.

Better seen in FIGS. 3-5, the novel metal frame 20 of the pump 10 incorporates integrated skid support structures 21 that serve to optimally brace and support the power end 12 according to the teachings of the present disclosure. The skid structures 21 are reinforced support structures engineered and integrally formed at the base along the front and back of the pump frame 20. Best seen in FIGS. 3 and 7, a series of inner chambers 23 are formed alongside a series of outer chambers 22. In one embodiment, the skid supports 21 comprise series of vertical struts forming rectangular inner and outer chambers that are integrally located at the base of the pump frame 20. The vertical struts of the inner chambers and the outer chambers may be staggered in location. Alternatively, a plurality of other suitable geometrically-shaped chambers can be used, such as square, triangular, honeycomb, and other shapes. It is important to note that the incorporation of these support structures 21 does not impact or alter the overall dimensional envelope or the mounting locations of the pump frame 20, which remains unchanged. Accordingly, the new pump 10 with the integral support skid structure 21 can easily be dropped in and serve as a replacement for older versions of the pump. As these pumps are typically installed by a third-party installer who may use non-standardized or undersized supports bolted to the pump frame, issues such as deflection in the pump frame, and mis-alignment of the bearings and other components often arise and may lead to pump performance issues, seal failures, and leaks as a result. These poorly-designed and undersized support may not provide the proper rigidity and foundation for the pump. The provision of the built-in engineered skid structures 21 described herein also facilitates and speeds-up the installation of these pumps, because the installer would not need to add or fasten any support to the pump.

Further as shown in the figures, the power end pump frame 10 is designed so that the welds used to assemble the pump frame components are external fillet welds 30 rather than groove welds, as in conventional pumps, which would require the employment of experienced and highly trained welders to assemble the frame.

As shown in the various views in FIGS. 6-11, the new power end 12 of the pump 10 also includes a single forging/casting/structure that incorporates a noseplate 32 with crosshead guide tubes 34 and support gussets 36. The integral noseplate 32, crosshead guide tube 34, and support gusset 36 forging/casting/structure of the power-end frame 20 of the positive displacement pump 10 replaces what was previously a noseplate component that is separately fabricated and then butt joined to individual crosshead tubes. The new design incorporates the noseplate 32 and the crosshead guide tubes 34 in a single forging/casting/structure that does not require the additional steps of welding or joining the components together. The new integrated design also eliminates bronze sleeves previously pressed into the crosshead that have surfaces that can be worn down and requires upkeep or replacement.

Figure 12:
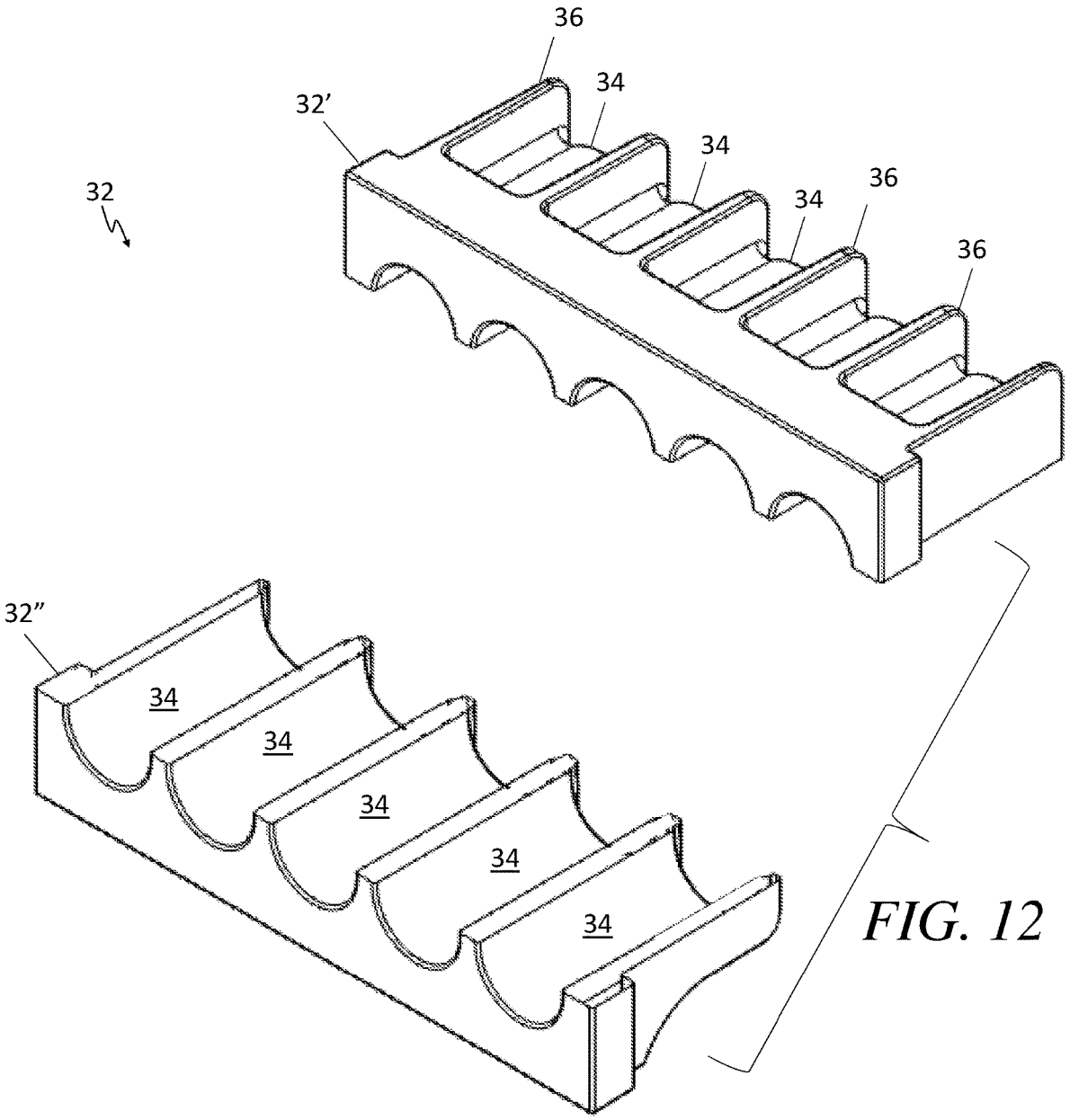
FIG. 12 is a perspective cross-sectional view of another exemplary embodiment of an integral crosshead guide tubes and noseplate structure according to the teachings of the present disclosure.

FIG. 12 is a perspective cross-sectional view of another exemplary embodiment of an integral crosshead guide tubes and noseplate structure according to the teachings of the present disclosure. Instead of a single forging/casting/structure, the noseplate and crosshead guide tube structure 32 may be fabricated from an upper forging/casting/structure 32' and a lower forging/casting/structure 32" and then joined together. In this alternate embodiment, the noseplate is still integrally formed with the crosshead guide tubes, but in two sections. Alternatively, the integral crosshead and noseplate can be fabricated in more than two sections that are then joined or welded together.

Figure 13:
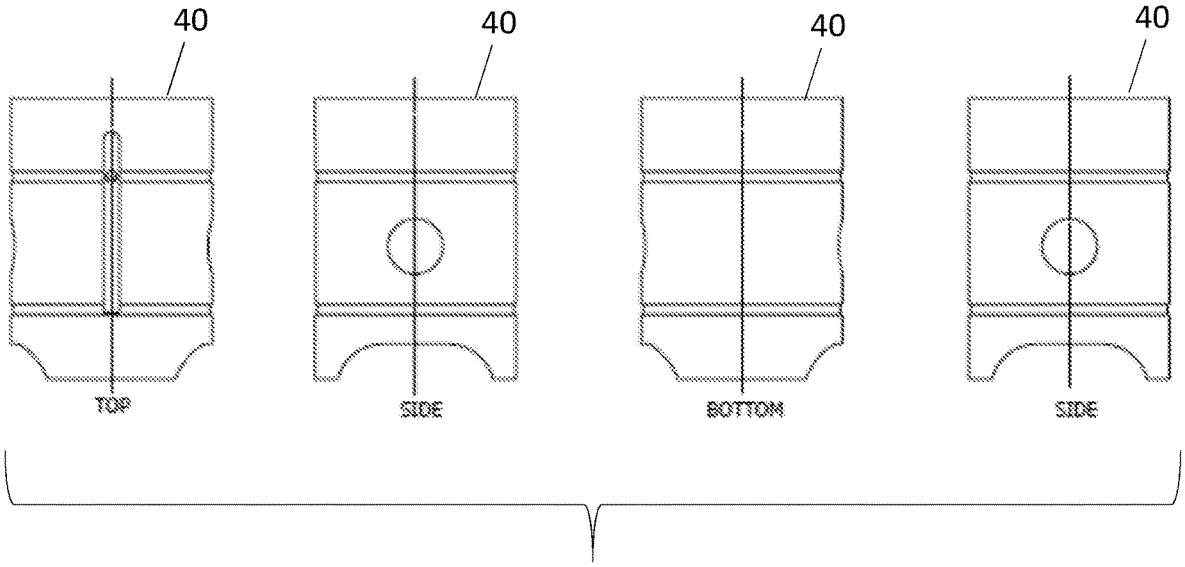
FIG. 13 presents various views of an exemplary crosshead design according to the teachings of the present disclosure.

FIG. 13 presents various views of an exemplary crosshead 40 according to the teachings of the present disclosure. A crosshead is a component used in the reciprocating pump to eliminate sideways pressure on the pony rod and plunger. The crosshead is generally coaxially disposed within the crosshead guide tube, which allows the crosshead to move along a reciprocating path therein. As the crank pin orbits with the crankshaft rotation, the attached connecting rod pivots and moves laterally back and forth within the crankshaft housing to reciprocate the crosshead within the crosshead guide tube. Previously in conventional designs, a bronze sleeve is press-fitted or shrink-fitted into the crosshead guide tube. In previous designs that have load bearing surfaces on the crosshead, a bronze shoe is mechanically attached. In the new design, a special coating such as Ni—Al-Bronze (Nickel-Aluminum-Bronze), a leaded bronze, ferrous, non-ferrous, or another wearable coating is applied to the outer circumferential surfaces of the crosshead. The wear bearing coating can be applied to the crosshead 40 by a suitable method, such as flame spraying, spraying, brushing, dipping, etc. depending on the specific coating used. The coating creates wearable surfaces on the crosshead itself instead of an added bearing or shoe and increases the durability of the crosshead. These added wearable components are difficult to replace when their surfaces are worn down. In the new design, when the crosshead surfaces are worn down, the crosshead itself can be replaced instead of the crosshead guide tubes that can be extremely difficult to extract. Further, because of the use of a coating rather than a shoe, potential mistakes associated with the manual shimming process during repair can be avoided.

Figure 14:
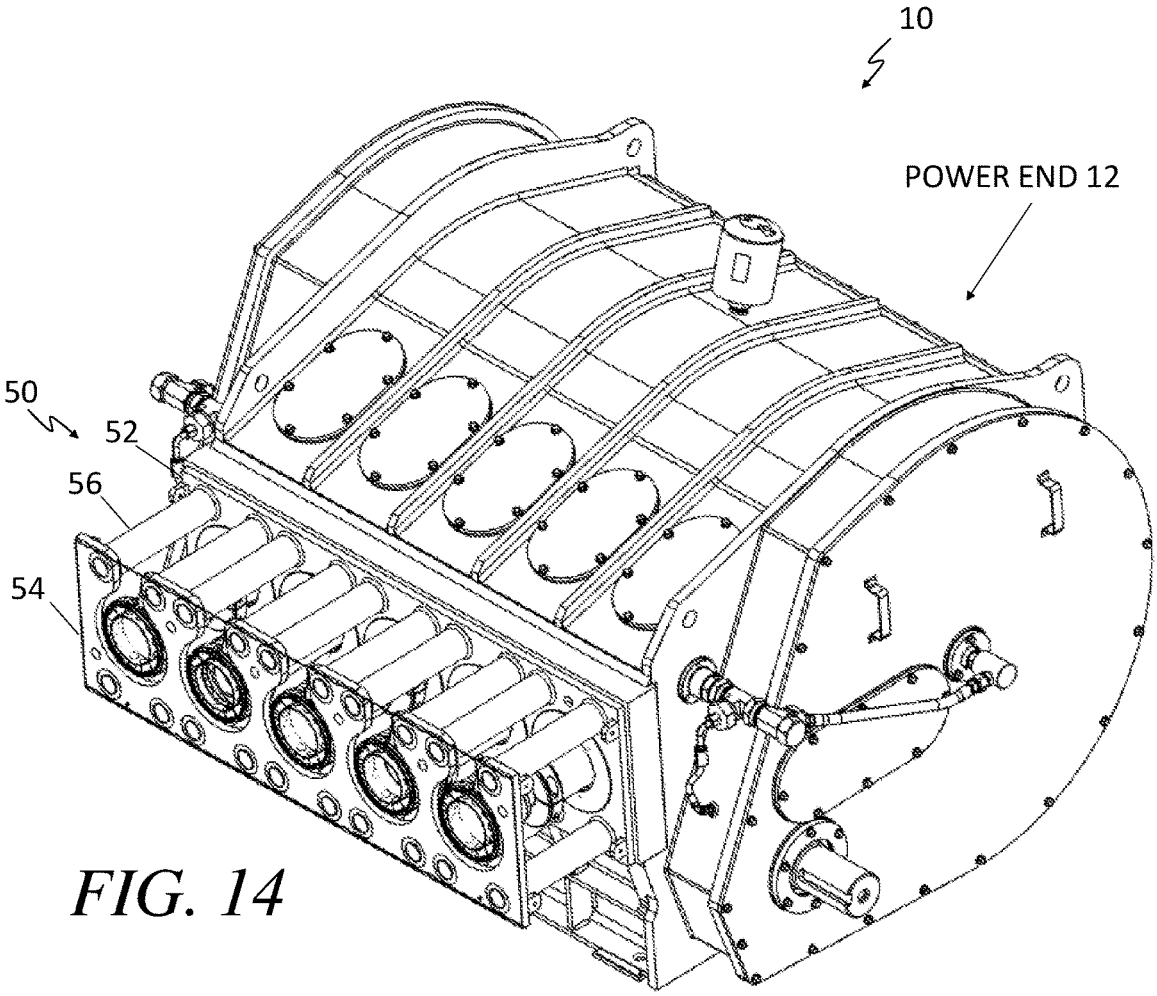
FIG. 14 is a perspective view of an exemplary power end of a positive displacement pump with an integrated stay rod assembly according to the teachings of the present disclosure.
Figure 15:
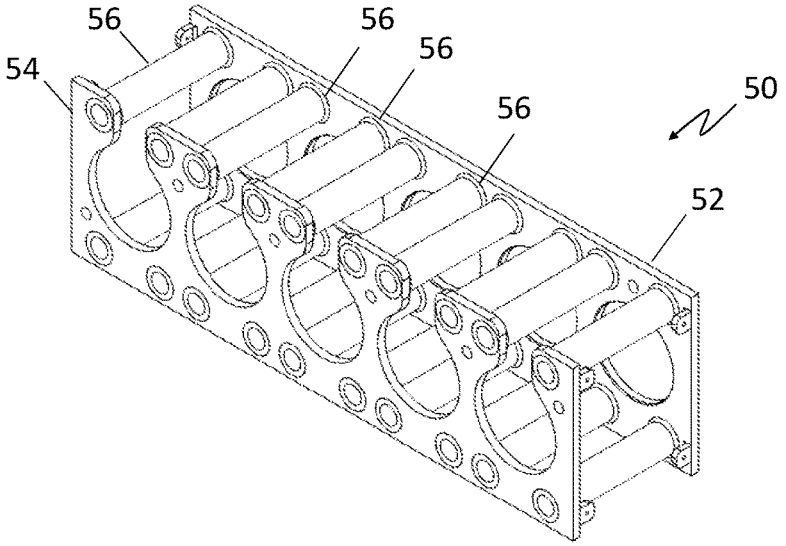
FIG. 15 is a perspective view of an exemplary integrated stay rod assembly according to the teachings of the present disclosure.

FIGS. 14 and 15 are perspective views of an exemplary power end of a positive displacement pump 10 with an integrated stay rod assembly 50 according to the teachings of the present disclosure. In a conventional pump design, separate individual stay rods and tubes are fabricated and machined independently, and assembled between the fluid end and power end. This often leads to misalignment because of small variations in the length of the tubes. The new design employs a single stay rod assembly 50 fabricated of multiple tubes 56 joined by two end plates 52 and 54. The tubes are joined to an end plate and then machined at the same time at the other end so that all tube lengths are the same. A single seal or O-ring seal (not explicitly shown) seated in a machined groove on the power end side 12 or the tube section plate side is used. Alignment pin holes and pins disposed in the end plates and power end and fluid end surfaces can be used to ensure proper alignment and installation. The result is better alignment between the fluid end and power end of the pump, fewer seal joints, and the elimination of over or under stretching or deformation of stay rods due to variable tube lengths. This also improves the life of sealed joints and produces less wear on pony rods and plungers.

The features of the present invention which are believed to be novel are set forth below with particularity in the appended claims. However, modifications, variations, and changes to the exemplary embodiments described above will be apparent to those skilled in the art, and the novel reciprocating pump frame with an integrated skid support structure, noseplate with crosshead guide tube forging/casting/structure, and crosshead coating described herein thus encompasses such modifications, variations, and changes and are not limited to the specific embodiments described herein.

What is claimed is:

1. A reciprocating pump power end housing, comprising:
a frame;
a skid support structure integrally formed at a base of the frame to provide support and rigidity for a power end of a reciprocating pump without altering outer dimensions of the power end;
an integrally-formed crosshead guide tube and noseplate structure; and
wherein the integrally-formed skid support structure comprises a plurality of struts forming a series of chambers.

2. The reciprocating pump power end housing of claim 1, wherein the integrally-formed support structure comprises a plurality of vertical struts forming a series of chambers having a shape selected from the group consisting of rectangular, square, and triangular.

3. The reciprocating pump power end housing of claim 1, wherein the integrally-formed support structure comprises a plurality of vertical struts forming a series of chambers at the base along a front and a back of the frame.

4. The reciprocating pump power end housing of claim 1, wherein the integrally-formed support structure comprises a plurality of vertical struts forming a series of inner chambers and a series of outer chambers at the base of the frame.

5. The reciprocating pump power end housing of claim 1, wherein the integrally-formed support structure comprises a plurality of vertical struts forming a series of inner chambers and a series of outer chambers at the base of the frame, wherein the location of the plurality of vertical struts of the series of inner chambers and the series of outer chambers is staggered.

6. The reciprocating pump power end housing of claim 1, wherein the integrally-formed crosshead guide tube and noseplate structure comprises an upper component and a lower component.

7. The reciprocating pump power end housing of claim 1, wherein the integrally-formed crosshead guide tube and noseplate structure are formed from a single structure.

8. The reciprocating pump power end housing of claim 1, wherein at least some components of the frame are assembled with external fillet welds.

9. The reciprocating pump power end housing of claim 1, further comprising a crosshead having a wearable coating applied on outer circumferential surfaces of the crosshead.

10. The reciprocating pump power end housing of claim 9, wherein the wearable coating on the crosshead is selected from the group consisting of a leaded bronze, Ni-Al-Bronze, and any other ferrous or non-ferrous material.

11. The reciprocating pump power end housing of claim 1, further comprising a stay rod assembly having a plurality of stay rods spanning between first and second end plates, wherein the stay rod assembly couples the power end to a fluid end of the reciprocating pump.

12. A power end of a reciprocating pump, comprising:
a frame;
a skid support structure integrally formed at a base of the frame configured to provide support and rigidity for the power end, the skid support structure including a plurality of substantially vertical struts forming a series of chambers at the base of the frame; and
an integrally-formed noseplate and crosshead guide tube structure, wherein the integrally-formed crosshead guide tube and noseplate structure comprises an upper component and a lower component.

13. The power end of claim 12, wherein the plurality of vertical struts form a series of horizontally-oriented chambers at the base along a front and a back of the frame.

14. The power end of claim 12, wherein the integrally-formed skid support structure comprises a plurality of substantially vertical struts forming a series of inner chambers and a series of outer chambers at the base of the frame.

15. The power end of claim 12, wherein the integrally-formed skid support structure comprises a plurality of vertical struts forming a series of inner chambers and a series of outer chambers at the base of the frame, where the location of the vertical struts of the inner chambers and the outer chambers is one of staggered or inline.

16. A reciprocating pump comprising:
a fluid end;
a power end coupled to the fluid end and having a housing with a frame;
a skid support structure integrally formed along a base of the housing configured to provide support and rigidity for the power end without altering an outer dimensional envelope of the housing; and
an integrally-formed noseplate and crosshead guide tube structure, wherein the integrally-formed skid support structure comprises a plurality of vertical struts forming a series of horizontally-oriented inner and outer chambers without altering outer dimensions of the housing.

17. The reciprocating pump of claim 16, wherein the location of the plurality of vertical struts of the series of horizontally-oriented inner and outer chambers is one of staggered or inline.

* * * * *